US009586129B2

(12) United States Patent
Henrie et al.

(10) Patent No.: US 9,586,129 B2
(45) Date of Patent: Mar. 7, 2017

(54) POWER AND STABILIZING APPARATUS

(71) Applicant: Braap, LLC, Gilbert, AZ (US)

(72) Inventors: Brandon Henrie, San Tan Valley, AZ (US); Shawn Wheeler, Gilbert, AZ (US)

(73) Assignee: BRAAP, LLC, Gilbert, AZ (US)

( * ) Notice: Subject to any disclaimer, the term of this patent is extended or adjusted under 35 U.S.C. 154(b) by 0 days.

(21) Appl. No.: 14/962,935

(22) Filed: Dec. 8, 2015

(65) Prior Publication Data

US 2016/0228759 A1 Aug. 11, 2016

Related U.S. Application Data

(63) Continuation of application No. 14/745,117, filed on Jun. 19, 2015.

(60) Provisional application No. 62/113,666, filed on Feb. 9, 2015.

(51) Int. Cl.
*A63C 11/22* (2006.01)
*B63H 16/04* (2006.01)

(52) U.S. Cl.
CPC ..... *A63C 11/227* (2013.01); *A63C 11/221* (2013.01); *A63C 11/222* (2013.01); *B63H 16/04* (2013.01)

(58) Field of Classification Search
CPC ..... A63C 11/22; A63C 17/0013; A63C 53/10; A63C 11/227; A63C 11/221; A45B 3/00; A45B 1/02; A45B 9/00; A45B 1/00; A45B 7/00; A45B 7/002
See application file for complete search history.

(56) References Cited

U.S. PATENT DOCUMENTS

| | | | | |
|---|---|---|---|---|
| 2,442,296 | A | 5/1948 | Lang | |
| 3,448,749 | A | 6/1969 | Stark | |
| 3,677,216 | A | 7/1972 | Gentemann | |
| 3,933,364 | A | 1/1976 | With | |
| 3,948,535 | A | 4/1976 | Negi | |
| 4,319,750 | A | 3/1982 | Roy | |
| 4,411,159 | A | 10/1983 | Spear | |
| 5,058,923 | A | 10/1991 | Dale | |
| 5,236,222 | A * | 8/1993 | Fletcher | A63C 17/0013 135/77 |

(Continued)

OTHER PUBLICATIONS

USPTO; Restriction Requirement dated Mar. 2, 2016 in U.S. Appl. No. 14/963,008.

(Continued)

*Primary Examiner* — Hau Phan
(74) *Attorney, Agent, or Firm* — Snell & Wilmer L.L.P.

(57) ABSTRACT

A power and stabilizing apparatus for rolling or sliding-based recreational activities is disclosed. The apparatus may include a shafted body coupled to a biased member. The biased member may be a bowed biased member or any other biased member configured to store and release energy during use of the apparatus. The apparatus may also include a shoe coupled to the biased member opposite the body, the shoe having a traction element coupled thereto. The body may be a shafted telescoping body configured to lock in an extended position and lock in a retracted position. The body may be coupled to the bowed biased member with a coupling member having a first leg coupled to the body and a second leg coupled to the bowed biased member.

12 Claims, 6 Drawing Sheets

(56) References Cited

U.S. PATENT DOCUMENTS

| | | | | |
|---|---|---|---|---|
| 5,236,223 | A | 8/1993 | Leon et al. | |
| 5,331,989 | A * | 7/1994 | Stephens | A45B 9/00 135/65 |
| 5,482,072 | A | 1/1996 | Cimino | |
| 5,505,492 | A * | 4/1996 | Nelson | A63C 11/22 280/819 |
| 5,534,203 | A | 7/1996 | Nelson et al. | |
| 5,564,451 | A | 10/1996 | Hagberg | |
| 5,820,424 | A | 10/1998 | Steinhour | |
| 5,984,359 | A * | 11/1999 | Faiks | A63C 11/22 135/86 |
| 6,042,438 | A | 3/2000 | Dean | |
| 6,306,178 | B1 | 10/2001 | Kania | |
| 6,644,328 | B1 | 11/2003 | Lenhart | |
| 6,733,042 | B1 | 5/2004 | Klemetti | |
| 6,796,862 | B1 | 9/2004 | Abbenhouse et al. | |
| 6,991,501 | B2 | 1/2006 | Wilce | |
| 7,021,232 | B2 | 4/2006 | Chen | |
| 7,311,573 | B1 | 12/2007 | Dillenschneider | |
| 7,377,551 | B2 | 5/2008 | Silverman | |
| 7,488,228 | B2 | 2/2009 | Scott | |
| 7,896,013 | B2 | 3/2011 | Lerner | |
| 7,951,051 | B1 | 5/2011 | Brown | |
| 7,954,502 | B2 | 6/2011 | Townsend | |
| 8,100,733 | B1 | 1/2012 | Ross | |
| 8,147,383 | B2 | 4/2012 | Bentley | |
| 8,337,372 | B1 | 12/2012 | Boterenbrood | |
| 8,371,886 | B1 | 2/2013 | Strangfeld | |
| 8,636,306 | B2 | 1/2014 | McBride | |
| 8,746,266 | B2 | 6/2014 | Palmer et al. | |
| 8,814,212 | B2 | 8/2014 | Bennett | |
| 8,858,401 | B2 * | 10/2014 | Kaupe | A45B 1/02 135/65 |
| 8,926,384 | B1 | 1/2015 | Alphin | |
| 8,974,232 | B2 * | 3/2015 | Behrenbruch | A45B 3/00 135/65 |
| 9,498,700 | B2 | 11/2016 | Henrie et al. | |
| 2003/0227167 | A1 * | 12/2003 | Redor | A63C 11/22 280/819 |
| 2004/0107981 | A1 * | 6/2004 | Smith | A45B 9/00 135/65 |
| 2004/0250845 | A1 | 12/2004 | Rudin | |
| 2007/0120352 | A1 | 5/2007 | Panizza | |
| 2007/0249472 | A1 | 10/2007 | Frei | |
| 2009/0004935 | A1 | 1/2009 | Branovits | |
| 2011/0065341 | A1 | 3/2011 | Potter | |
| 2011/0101664 | A1 | 5/2011 | Gonzalez et al. | |
| 2012/0015785 | A1 | 1/2012 | Burroughs | |
| 2012/0024634 | A1 | 2/2012 | Walker | |
| 2012/0042918 | A1 * | 2/2012 | Tessier | A45B 1/00 135/67 |
| 2012/0049502 | A1 | 3/2012 | Ascunce | |
| 2012/0139224 | A1 | 6/2012 | Weir | |
| 2012/0200073 | A1 | 8/2012 | Bennett | |
| 2012/0267872 | A1 | 10/2012 | McBride | |
| 2014/0014148 | A1 * | 1/2014 | Halonen | A45B 7/00 135/65 |
| 2014/0287884 | A1 | 9/2014 | Buchanan | |
| 2014/0345958 | A1 | 11/2014 | Lavarack | |
| 2015/0291268 | A1 | 10/2015 | Shoemaker | |

OTHER PUBLICATIONS

USPTO; Non-Final Office Action dated Mar. 29, 2016 in U.S. Appl. No. 14/963,008.

U.S. Appl. No. 14/845,135, filed Sep. 3, 2015 which has two common inventors with the present application.

U.S. Appl. No. 14/745,117, filed Jun. 19, 2015 which has two common inventors with the present application.

Presentation du Paddle Road; https://www.youtube.com/watch?v=FBtp7judiUQ.

PCT; International Search Report and Written Opinion dated May 24, 2016 in Application No. PCT/US2016/015549.

Braap, et al., "Complaint," Case No. CV2015-013591, Superior Court of the State of Arizona in and for the County of Maricopa, Dec. 8, 2015, pp. 1-24.

Powerstick, et al., "Answer and Counterclaims," Case No. CV2015-013591, Superior Court of the State of Arizona in and for the County of Maricopa, Jan. 12, 2016, pp. 1-34.

Powerstick, Inc., "Assignment," dated Feb. 6, 2015.

USPTO; Power of Attorney filed by K. Booth dated Jun. 19, 2015 in U.S. Appl. No. 14/745,117.

USPTO; Request to Change the Applicant to PowerStick, Inc., Assignee Showing of Ownership, and Power of Attorney filed by Langlotz Patent and Trademark Works dated Nov. 3, 2015 in U.S. Appl. No. 14/745,117.

USPTO; Petition to Suspend Rules, Revoke Previous Power of Attorney, and Request to Grant Power of Attorney to Snell & Wilmer L.L.P. filed Nov. 6, 2015 in U.S. Appl. No. 14/745,117.

USPTO; Notice of Acceptance of Power of Attorney filed by Langlotz dated Nov. 12, 2015 in U.S. Appl. No. 14/745,117.

USPTO; Notice Revoking Booth Udall Fuller, PLC Power of Attorney dated Nov. 12, 2015 in U.S. Appl. No. 14/745,117.

USPTO; Request to Correct Inventorship filed by Langlotz Patent and Trademark Works, Inc. dated Nov. 16, 2015 to remove inventors B. Henrie and S. Wheeler from U.S. Appl. No. 14/745,117.

USPTO; Denial of Request for Power of Attorney filed by Snell & Wilmer L.L.P. dated Nov. 17, 2015 in U.S. Appl. No. 14/745,117.

USPTO; Denial of Request of Power of Attorney to Langlotz Patent and Trademark Works, Inc. dated Sep. 19, 2016 in U.S. Appl. No. 14/745,117.

USPTO; Denial of Request of Power of Attorney to Snell & Wilmer L.L.P. dated Sep. 20, 2016 in U.S. Appl. No. 14/745,117.

USPTO; Improper Submission of Request Under 37 CFR 1.48(a) to Change Inventorship dated Sep. 20, 2016 filed by Langlotz Patent and Trademark Works on Nov. 16, 2015 in U.S. Appl. No. 14/745,117.

USPTO; Non-Final Office Action dated Oct. 5, 2016 in U.S. Appl. No. 14/745,117.

USPTO; Decision on Petition to Suspend Rules, Revoke Previous Power of Attorney, and Request to Grant Power of Attorney to Snell & Wilmer L.L.P. filed Nov. 6, 2015 in U.S. Appl. No. 14/745,117, granted on Oct. 27, 2016.

USPTO; Notice of Abandonment dated Nov. 1, 2016 in U.S. Appl. No. 14/745,117.

USPTO; Request for Withdrawal as Attorney or Agent and Change of Correspondence Address filed by Booth Udall Fuller, PLC dated Dec. 9, 2016 in U.S. Appl. No. 14/745,117.

USPTO; Notice Regarding Request to Withdrawal as Attorney or Agent filed by Booth Udall Fuller, PLC not accepted dated Dec. 16, 2016 in U.S. Appl. No. 14/745,117.

USPTO; Power of Attorney filed by K. Booth dated Sep. 3, 2015 in U.S. Appl. No. 14/845,135.

USPTO; Petition to Suspend Rules, Revoke Previous Power of Attorney, and Request to Grant Power of Attorney to Snell & Wilmer L.L.P. filed Nov. 6, 2015 in U.S. Appl. No. 14/845,135.

USPTO; Request to Change the Applicant to PowerStick, Inc., Assignee Showing of Ownership, and Power of Attorney filed by Langlotz Patent and Trademark Works dated Nov. 16, 2015 in U.S. Appl. No. 14/845,135.

USPTO; Denial of Request of Power of Attorney to Snell & Wilmer L.L.P. dated Nov. 17, 2015 in U.S. Appl. No. 14/845,135.

USPTO; Notice of Acceptance of Power of Attorney filed by Langlotz dated Nov. 30, 2015 in U.S. Appl. No. 14/845,135.

USPTO; Notice Revoking Booth Udall Fuller, PLC Power of Attorney dated Nov. 30, 2015 in U.S. Appl. No. 14/845,135.

USPTO; Denial of Request of Power of Attorney to Langlotz Patent and Trademark Works, Inc. dated Sep. 19, 2016 in U.S. Appl. No. 14/845,135.

USPTO; Decision on Petition to Suspend Rules, Revoke Previous Power of Attorney, and Request to Grant Power of Attorney to Snell & Wilmer L.L.P. filed Nov. 6, 2015 in U.S. Appl. No. 14/845,135, granted on Oct. 4, 2016.

USPTO; Restriction Requirement dated Nov. 16, 2016 in U.S. Appl. No. 14/845,135.

(56) References Cited

OTHER PUBLICATIONS

USPTO; Request for Withdrawal as Attorney or Agent and Change of Correspondence Address filed by Booth Udall Fuller, PLC dated Dec. 9, 2016 in U.S. Appl. No. 14/845,135.
Assignment filed May 27, 2016 from inventors B. Henrie and S. Wheeler to Braap, LLC and recorded at Reel/Frame 038740/0547.
USPTO; Response to Restriction Requirement dated Mar. 4, 2016 in U.S. Appl. No. 14/963,008.
USPTO; Interview Summary dated May 5, 2016 in U.S. Appl. No. 14/963,008.
USPTO; Response to Office Action dated May 31, 2016 in U.S. Appl. No. 14/963,008.
USPTO; Interview Summary dated Sep. 15, 2016 in U.S. Appl. No. 14/963,008.
USPTO; Notice of Allowance dated Sep. 15, 2016 in U.S. Appl. No. 14/963,008.
USPTO; Corrected Notice of Allowance dated Oct. 19, 2016 in U.S. Appl. No. 14/963,008.
USPTO; Issue Notification dated Nov. 2, 2016 in U.S. Appl. No. 14/963,008.
Letter from B. Braxton to D. Barker dated Dec. 9, 2016 re *Braap* v. *Powerstick* litigation matter.

* cited by examiner

POWER AND STABILIZING APPARATUS

CROSS REFERENCE TO RELATED APPLICATIONS

This application is a continuation of and claims priority to U.S. patent application Ser. No. 14/745,117 filed Jun. 19, 2015 entitled "POWER AND STABILIZING APPARATUS", which claims priority to U.S. Provisional Patent Application No. 62/113,666, filed on Feb. 9, 2015 entitled "POWER AND STABILIZING APPARATUS", the contents of which are hereby incorporated by reference.

BACKGROUND

1. Technical Field

Aspects of this document relate generally to apparatus for propelling individuals participating in rolling or sliding-based recreational activities.

2. Background Art

Skateboarders and other individuals participating in rolling/sliding-based recreational activities are often without apparatuses that will stabilize the user and provide power to the user in motion.

SUMMARY

According to one aspect, a recreational power and stabilizing apparatus comprises an elongated handle body, a bowed biased member coupled to the elongated handle body, and a shoe. The bowed biased member comprises a first end positioned proximate the elongated handle body, a second end opposite the first end, and an arc extending longitudinally relative to an axis of the elongated handle body. The shoe is coupled to and supported by the second end of the biased member.

Various implementations and embodiments may comprise one or more of the following. The shoe may comprise a traction element. The elongated handle body may comprise a telescoping shaft configured to lock in an extended position and lock in a retracted position shorter than the extended position. The elongated handle body may be coupled to the bowed biased member with a coupling member comprising a first leg coupled to the body and a second leg coupled to the bowed biased member. A handle grip may be coupled to a first end of the elongated handle body, and the first leg of the coupling member may comprise a body receiver channel extending through the first leg. The elongated handle body may be slidable within the body receiver channel and movable between a locked operating position and a collapsed position wherein a second end of the elongated handle body is closer to the shoe than when the elongated handle body is in the operating position. The bowed biased member may comprise a leaf spring comprising one of fiberglass and carbon fiber.

According to another aspect, a recreational power and stabilizing apparatus, comprises an elongated handle body, a leaf spring, and a traction element. The leaf spring comprises a first end coupled to the elongated handle body and a second end opposite the first end. The traction element is coupled to the second end of the leaf spring.

Various implementations and embodiments may comprise one or more of the following. The leaf spring may extend longitudinally relative to the elongated handle body. The elongated handle body may comprise a telescoping shafted body configured to lock in an extended position and lock in a retracted position shorter than the extended position. The elongated handle body may be coupled to the leaf spring with a coupling member comprising a first leg coupled to the body and a second leg coupled to the bowed biased member. The first leg of the coupling member may comprise a body receiver channel extending through the first leg, the elongated handle body being slidable within the body receiver channel and movable between a locked operating position and a collapsed position wherein an end of the elongated handle body is closer to the shoe than when the elongated handle body is in the operating position. A handle coupled to the elongated handle body opposite the leaf spring and a wheel coupled to the shoe. The traction element may be coupled to a shoe pivotally coupled to the second end of the leaf spring. The leaf spring may comprise one of fiberglass or carbon fiber.

According to another aspect, a recreational power and stabilizing apparatus comprises an elongated handle body coupled to a non-linear biased member. The non-linear biased member extends from a first side of the elongated handle body and does not cross a plane collinear with an axis of the elongated handle body more than once in a total length of the non-linear biased member such that the non-linear biased member deforms when a force is applied to the non-linear biased member by the elongated handle body and reforms when the force is not applied to the non-linear biased member by the elongated handle body to store and release energy during use of the recreational power and stabilizing apparatus.

Various implementations and embodiments may comprise one or more of the following. A traction element coupled to the biased member and a handle coupled to the elongated handle body. The non-linear biased member may comprise a leaf spring positioned longitudinally to the axis of the elongated handle body. The leaf spring may comprise one of fiberglass or carbon fiber. The elongated handle body may comprise a telescoping shaft configured to lock in an extended position and lock in a retracted position shorter than the extended position. The telescoping shaft is coupled to the biased member with a coupling member comprising a first leg coupled to the telescoping shaft and a second leg coupled to the biased member, wherein the first leg of the coupling member comprises a body receiver channel extending through the first leg, the telescoping shaft being slidable within the body receiver channel and movable between a locked operating position and a collapsed position wherein an end of the telescoping shaft is closer to the shoe than when the elongated handle body is in the operating position.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1A:
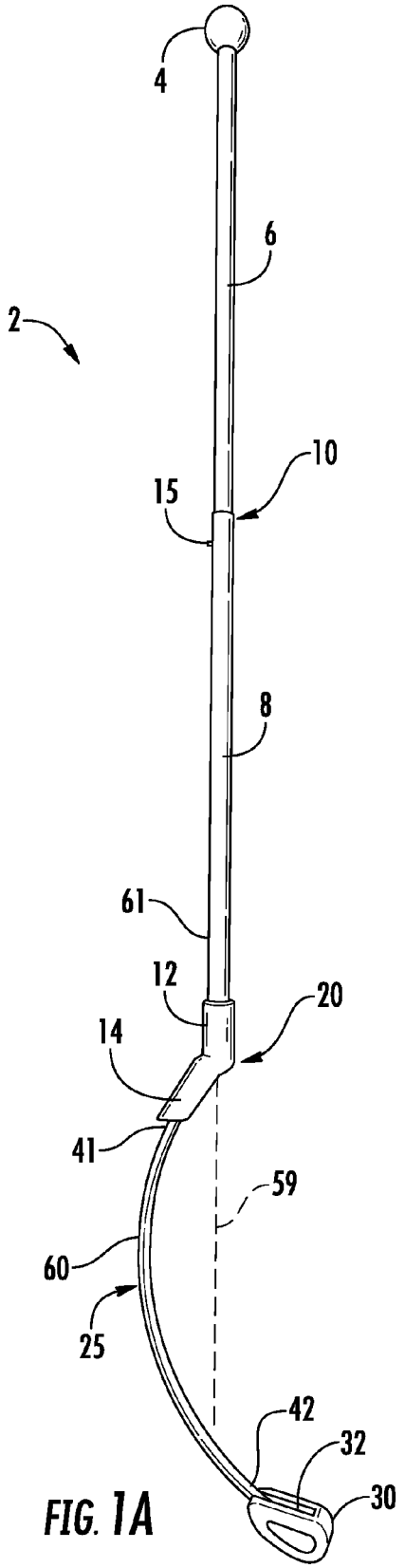
FIG. 1A is a side view of a recreational power and stabilizing apparatus in an extended position.

This disclosure, its aspects and implementations, are not limited to the specific components or assembly procedures disclosed herein. Many additional components and assembly procedures known in the art consistent with the intended apparatus and/or assembly procedures for a stabilizing and power apparatus will become apparent for use with implementations of stabilizing and power apparatuses from this disclosure. Accordingly, for example, although particular handles, bodies, coupling members, biased members, and shoes are disclosed, such handles, bodies, coupling members, biased members, and shoes and implementing components may comprise any shape, size, style, type, model, version, measurement, concentration, material, quantity, and/or the like as is known in the art for handles, bodies, coupling members, biased members, and shoes and implementing components, consistent with the intended operation of a stabilizing and power apparatus.

Contemplated as part of this disclosure is an apparatus configured to provide power and balance or stabilization to a user participating in an athletic and/or movement-based activity. For example, the apparatus may be utilized by an individual on a skateboard, long board rollerblades, roller skates, skiing, snowboarding, kayaking, ice skating, cross country skiing, and the like. Operation and advantages of the apparatus will become apparent to one of ordinary skill in the art upon review of the disclosures presented in this document. Generally, one or more embodiments of a recreational power and stabilizing apparatus 2 comprise a handle grip 4, an elongated handle body 10 coupled to the handle grip 4, a coupling member 20 coupled to the elongated handle body 10, a biased member 25 coupled to the coupling member 10, and a shoe 30 coupled to the biased member 25. More specific detail of various embodiments of a recreational power and stabilizing apparatus 2 shall be provided herein.

Figure 1B:
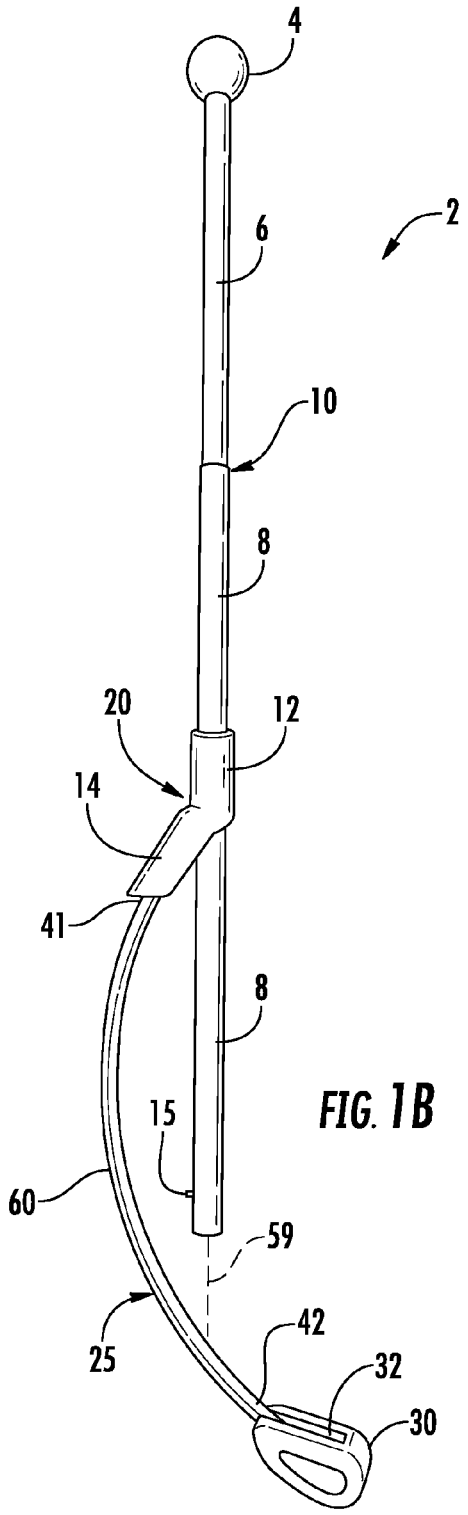
FIG. 1B is a side view of a recreation power and stabilizing apparatus in a collapsed position.
Figure 2:
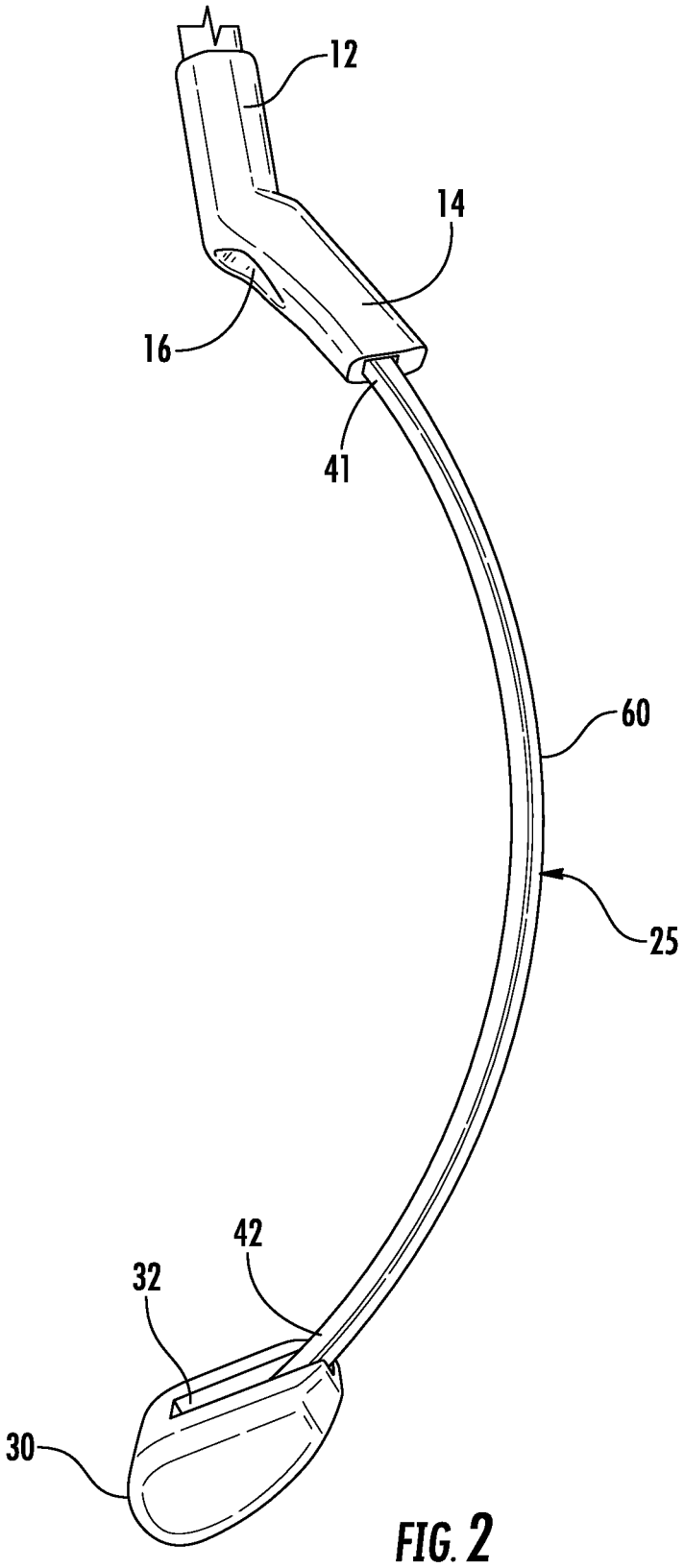
FIG. 2 is a side view of a bowed biased member of a recreational power and stabilizing apparatus.

One or more embodiments of a balance or stabilizing and power apparatus comprise a biased member. The biased member may comprise any biased member configured to store and release energy during use. FIGS. 1A and 1B depict sides views of a non-limiting embodiment of a recreational power and stabilizing apparatus 2 that includes a bowed biased member 25, and FIG. 2 depicts a close up view of a bowed and non-linear biased member 25 of a non-limiting embodiment of a recreational power and stabilizing apparatus 2. According to some aspects, a biased member contemplated in this disclosure may comprise any configuration that allows the biased member to store kinetic energy from the user applying pressure to the biased member from the handle grip 4 or elongated handle body 10 as potential energy. For example, a user may apply pressure to the biased member 25 while in motion (such as a when rolling on a long board) by pushing the shoe of the apparatus against the ground or other surface, thus deforming the shape of the biased member 25 and loading energy into the biased member 25. As the user continues in motion beyond the contact point of the shoe 30 of the apparatus 2 and the ground, the biased member 25 regains its shape and transfers a force or energy to the user in motion, thus propelling the user.

The biased member 25 may comprise any biased member known in the art, such as but not limited to a non-linear biased member. In the non-limiting embodiment depicted in FIGS. 1 and 2, the non-linear biased member comprises bowed or arced leaf spring biased member 25. As used herein, a coil spring is a linear biased member and not a non-linear or bowed biased member because when it is compressed axially, its force is exerted axially. According to some aspects, a biased member 25 is non-linear and extends from a first side 61 of an elongated handle body 10, but does not cross a plane collinear with an axis 59 of the elongated handle body 10 more than twice in a total length of the non-linear biased member 25. As used herein, a curve or arc 60 of a biased member is to be understood to extend beyond the end of the biased member itself so that it intersects with a center axis of the elongated handle body 10. In one or more embodiments, a bowed or non-linear biased member 25 comprises an arc 60 that extends longitudinally relative to an axis 59 of the elongated handle body, contrary to the coils of a coil spring, which extend latitudinally relative to an axis. It is further contemplated that a bowed biased member 25 may comprise an angled, non-linear biased member.

A biased member 25 may comprise any of a number of materials known in the art, such as but not limited to metals, plastics, and the like. In one or more embodiments, a non-linear biased member comprises a bowed biased member 25 comprising fiberglass or carbon fiber (such as a carbon fiber-reinforced polymer). In other embodiments, a non-linear biased member may comprise other shapes and configurations utilizing similar materials. A biased member 25 may vary in size and dimensions according to the desired weight-rated spring loads for different users.

Figure 5A:
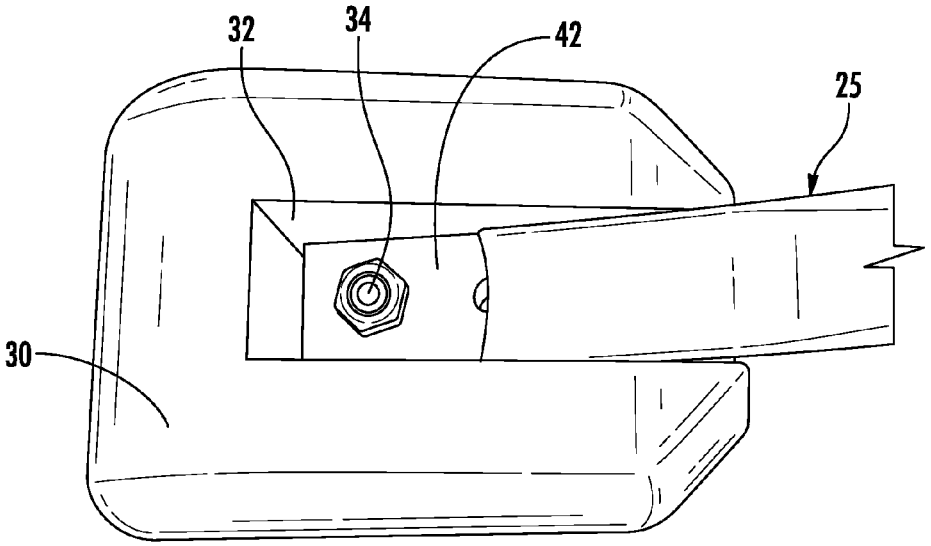
FIG. 5A is a top view of a shoe of a recreational power and stabilizing apparatus.
Figure 5B:
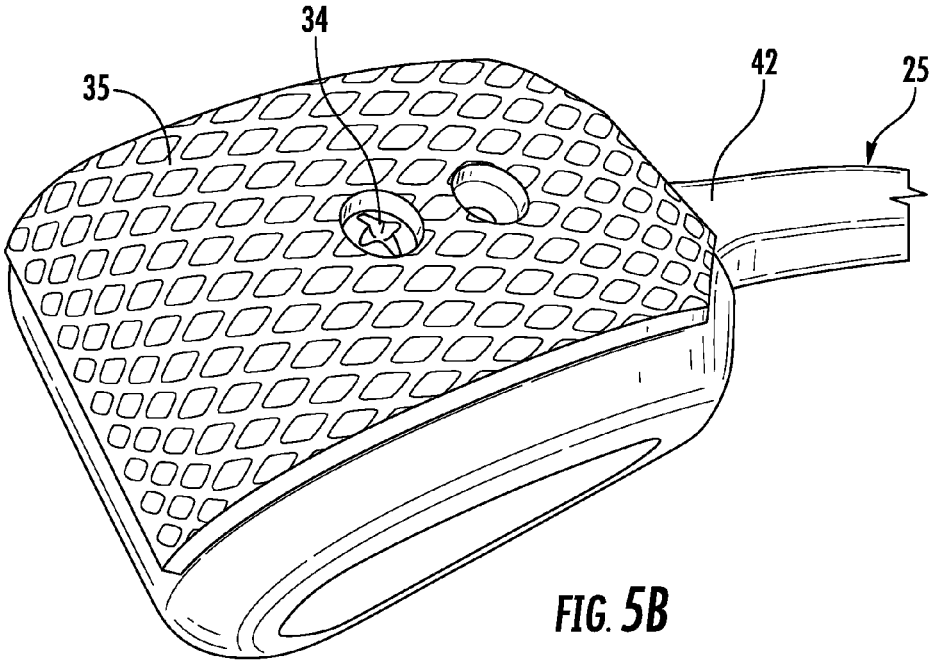
FIG. 5B is a bottom view of a base coupled to a shoe of a recreational power and stabilizing apparatus.

One or more embodiments of a recreational power and stabilizing apparatus 2 comprise a shoe 30 coupled to the recreational power and stabilizing apparatus 2 proximate a second end 42 of a biased member 25. FIGS. 1 and 2 depict a non-limiting embodiment of a shoe 30 on a recreational power and stabilizing apparatus 2, and FIGS. 5A and 5B depict close up top and bottom views, respectively, of a non-limiting embodiment of a shoe 30 coupled to a second end 42 of a biased member 25. In combination with the biased member 25, a user is able pull himself (on a skateboard, for example) by reaching the shoe 30 in front himself to engage the shoe 30 with the ground. The user then pushes (or loads) the biased element 25 as he/she continues past the shoe 30 engaged with the ground until the biased member 25 releases (or springs) and transfers additional force to the user.

In one or more embodiments, a shoe 30 comprises a slot 32, channel, bracket, or the like configured to receive and/or couple to a second end 42 of a biased member 25. The slot 32 may be sized such that a portion of the biased member 25 fits between sidewalls of the slot 32. In the non-limiting embodiment depicted in FIG. 5A, the slot 32 is positioned on a top side of the shoe 30. In other embodiments, a slot may extend into the shoe 30 or be positioned elsewhere on the shoe 30. One or more couplings may be used to hold a second end 42 of the biased member 25 between the sidewalls of the slot 32, such as but not limited to nuts and bolts 34, screws, pins, and the like and/or any combination thereof. In FIGS. 5A and 5B, the shoe 30 is illustrated as coupled to the biased member 25 with a single nut and bolt 34, with a second nut and bolt removed to show the screw opening extending through the biased member 25, the shoe 30, and the traction element 35. The one or more couplings may extend all the way through to a bottom side of the shoe 30 to also couple a traction element 35 to the shoe 30, or may extend only partially into the shoe 30. Alternatively, one or more couplings may be used to couple a biased member 25 to a surface of the shoe 30 devoid of a slot 32. In other embodiments, a shoe 30 may comprise a pin or other member proximate a terminating end of the slot or a bracket, the pin or other member being configured to support the biased member 25 within the slot or bracket between the sidewalls of the slot bracket, the center wall of the slot or bracket, and the pin. According to some non-limiting aspects, a shoe 30 is configured to removably couple to a biased member 25, thus allowing a user to alternate between different shoe configurations depending on the terrain and/or wear on the shoe.

In one or more embodiments, the shoe 30 further comprises a base or traction element 35. The traction element 35 is configured to provide traction or other engagement between the shoe 30 (or the biased member 25) and the surface to which the traction element 35 will interact to provide energy to the user. According to some aspects, the traction element 35 is curved, either with a curve of the bottom of shoe 30 or independent of the shoe 30. In some embodiments a traction element 35 comprises a replaceable brake pad removably coupled to the shoe 30. More particularly, a traction element 35 may be bolted or screwed to the shoe 30. In other embodiments, a traction element may be coupled to a shoe with adhesive or other couplings known in the art. In still other embodiments, a traction element 35 may be coupled directly to a biased member 25. A traction element 35 may comprise any durable rubber or rubber-molded piece that is soft enough that it does not slip against typical surfaces but strong enough that it is does not easily degrade or tear apart. Although the shoe 30 depicted in the FIG. 5B comprises a brake pad, it is contemplated that other embodiments may comprise a wheel, carving element, or other braking element.

In one or more embodiments, a shoe 30 is pivotally coupled to a biased member 25. For example, a shoe 30 may be coupled to a biased member 25 with a single bolt 34. In such embodiments, the slot 32 may be sized to allow the second end 42 of the biased member 25 to pivot within the slot 32. The walls of the slot 32, however, prevent the second end 42 of the biased member 25 from pivoting beyond a desired angle. Such a configuration is advantageous because it allows the shoe 30 to rotate or pivot slightly when the shoe contacts the ground if the elongated handle body 10 and biased member 25 are at an angle, thus providing an increased surface area of contact between the shoe 30 and the ground. In other embodiments, screw holes extending through the shoe 30 may comprise slotted holes that allow the shoe to pivot upon contact with the ground.

Figure 6:
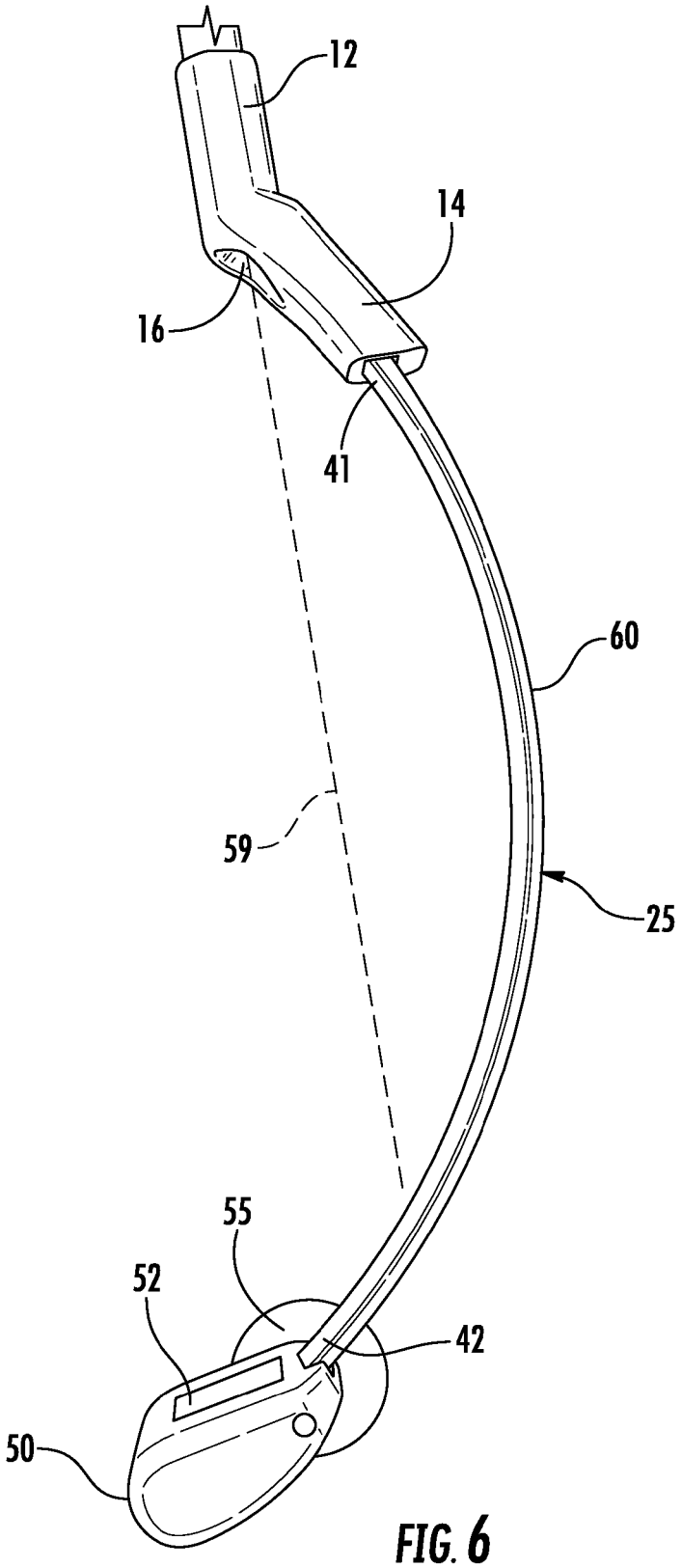
FIG. 6 is a side view of a bowed biased member of a second embodiment of a recreational power and stabilizing apparatus.

According to some aspects, a shoe 30 may further comprise a wheel 55 coupled thereto. FIG. 6 depicts a non-limiting embodiment of a recreational power and stabilizing apparatus comprising a wheel 55 rotatably coupled to the shoe 50. The wheel 55 may be coupled to the shoe 50 with any coupling known in the art, such as but not limited to a nut and bolt, pin, screw, rivet, and the like. The wheel 55 may be free-spinning and/or powered by motor 52 housed within or otherwise coupled to the shoe 50. The motor 52 may powered by rechargeable batteries or gasoline. According to some aspects, the motor is operably coupled to an activation switch positioned on the handle or body, such that a user may start or stop the motor 52 via the activation switch.

One or more embodiments of a recreational power and stabilizing apparatus 2 further comprise an elongated handle body 10 coupled to the biased member 25. An elongated handle body 10 is configured to allow a user to direct a biased member 25 and/or shoe 30 during use, as well as hold the recreational power and stabilizing apparatus 2. According to some aspects, an elongated handle body 10 comprises a shafted elongated handle body 10 coupled to a biased member 25. More particularly, the elongated handle body 10 may comprise a substantially straight and cylindrical aluminum shafted body. FIGS. 1A and 1B depict side views of a non-limiting embodiment of a recreational power and stabilizing apparatus 2 comprising a shafted elongated handle body 10. In other embodiments, the elongated handle body 10 may comprise other various shapes, materials, and geometric configurations. For example, the body may comprise other materials such as but not limited to plastics, carbon fiber material, wood, metal, and the like.

Figure 3A:
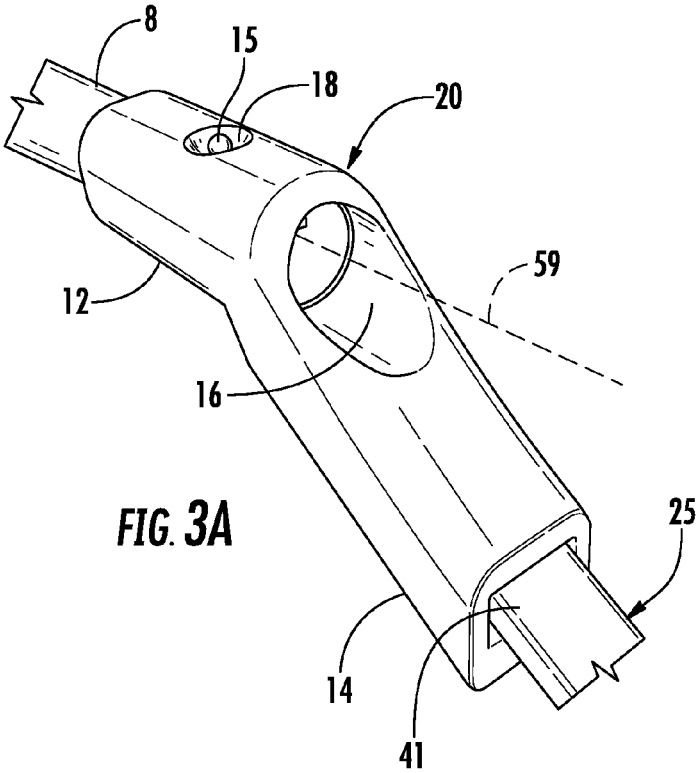
FIG. 3A is a top perspective view of a coupling member of a recreational power and stabilizing apparatus.

In some embodiments, an elongated handle body 10 comprises an adjustable length body, such as but not limited to a shafted telescoping elongated handle body 10 comprising a first shaft 6 and at least a second shaft 8. A non-limiting embodiment of an adjustable length body is shown and described in FIGS. 1A, 1B, and 4. In some embodiments, a shafted telescoping elongated handle body 10 is adjustable between two or more positions, such as but not limited to an operating position and a collapsed position. In an operating position, a shafted telescoping elongated handle body 10 extends from a coupling member 20 and is not likely to interfere with bending or use of the biased member, such as the non-limiting embodiment shown in FIG. 1A. In a collapsed position, a portion of the shafted telescoping elongated handle body 10 may extend between the coupling member 20 and the shoe 30, thus shortening the overall length of the recreational power and stabilizing apparatus 2 and also providing and additional handle for carrying the recreational power and stabilizing apparatus 2 when not in use. FIG. 1B depicts a non-limiting embodiment of a recreational power and stabilizing apparatus 2 in a collapsed position. It is noted that, according to some aspects, a recreational power and stabilizing apparatus 2 is still operable in a collapsed position. Various couplings known in the art may be utilized to lock the elongated handle body 10 in either the operating or collapsed position, such as but not limited to one or more spring pins 15 in the elongated handle body 10 extending through one or more holes 18 in the coupling member 20. For example, FIG. 3A shows a spring pin 15 engaged with a hole 18 on the coupling member 20 locking the elongated handle body 10 in an operating position. A similar engagement between other spring pins or couplings on the body may lock the body in a collapsed position.

Figure 4:
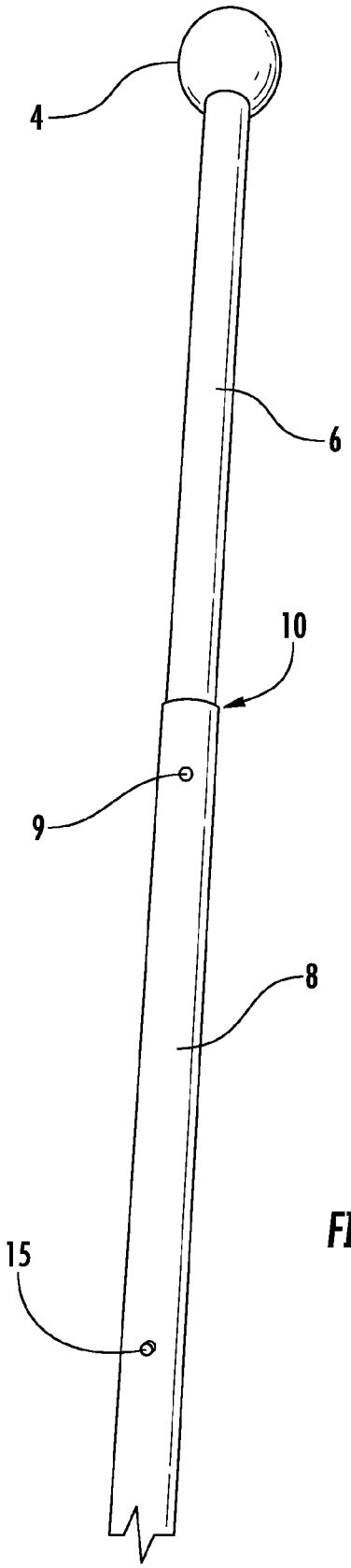
FIG. 4 is a side view of a body of a recreational power and stabilizing apparatus in a retracted position.

Whether in an operating position or a collapsed position, a shafted telescoping elongated handle body 10 may be adjustable between an extended and retracted position wherein the first shaft 6 slides within the second shaft 8, or vice versa, to extend or retract the length of the shafted elongated handle body 10. In FIG. 1A, the shafted elongated handle body 10 is shown in an extended position, while in FIG. 4 the shafted elongated handle body 10 is shown in a retracted position wherein the length of the shafted elongated handle body 10 is shorter than in the extended position. Various couplings known in the art may be utilized to lock the shafted elongated handle body 10 in either the extended or retracted position, such as but not limited to one or more spring pins 15 in the shafted elongated handle body 10 extending through one or more holes 9 in the coupling member second shaft 8. For example, FIG. 1A shows a spring pin 15 engaged with an upper hole on the second shaft 8, thus locking the shafted elongated handle body 10 in an extended position. FIG. 4 shows a spring pin 15 engaged with a lower hole on the second shaft 8, leaving the upper hole 9 open and locking the shafted body in a retracted position. Various embodiments may comprise a plurality of holes for adjusting the length of the shafted elongated handle body 10 to numerous desired lengths.

Non-limiting embodiments of an elongated handle body 10 may further comprise a handle grip 4 coupled to the elongated handle body 10. The handle grip 4 may comprise any handle known in the art that provides an improved gripping function for the user. In the non-limiting embodiment depicted in FIGS. 1 and 4, the handle grip 4 is substantially spherical and coupled to the elongated handle body 10 opposite the biased member 25. Some embodiments, however, may be devoid of such a handle. Other embodiments may comprise a second handle positioned on the elongated handle body 10 between the first handle grip 4 and the coupling member 20. Regardless of the shape or configuration, the handle grip 4 may be fixed or rotatable to adapt to different grasping positions. In some embodiments, the handle may be grip shaped and have indentations for finger grips, or be oblong shaped like a typical boat paddle handle.

As referenced above, a recreational power and stabilizing apparatus 2 may comprise a coupling member 20 configured to couple an elongated handle body 10 to a biased member 25. The coupling member 20 may comprise one or more of a variety of materials, such as but not limited to any plastics, carbon fiber material, metals, and the like known in the art. A coupling member 20 may comprise any coupling member configured to couple an elongated handle body 10 to a biased member 25, and is not limited to the coupling member 20 demonstrated in FIGS. 1-3. According to some aspects, a coupling member 20 comprises a first leg 12 configured to couple to an elongated handle body 10 and a second leg 14 configured to couple to a biased member 25. The first leg 12 and the second leg 14 may comprise any configuration for coupling the elongated handle body 10 and the biased member 25, respectively, to the coupling member 20.

In the non-limiting embodiment depicted in FIGS. 1-3, the first leg 12 comprises a body receiver 16 adapted to receive the elongated handle body 10. More specifically, the body receiver 16 comprises a channel extending entirely through the first leg 12 to allow the elongated handle body 10 to slide entirely through the first leg 12. Such a configuration allows for adjustable positioning of the elongated handle body 10 between an operating position and a collapsed position. It is also contemplated, however, that a body receiver 16 may extend only partially into the first leg 12. Accordingly, in various contemplated embodiments, a body receiver 16 is sized to interface with at least a portion of the elongated handle body 10. A first leg 12 may further comprise a hole 18 sized to receive a spring pin 15 to temporarily lock the elongated handle body 10 in place relative to the coupling member 20. In other embodiments, any coupling known in the art may be utilized to temporarily or permanently lock the elongated handle body 10 in place relative to the coupling member 20, such as but not limited to screws, bolts, pins, and the like.

Figure 3B:
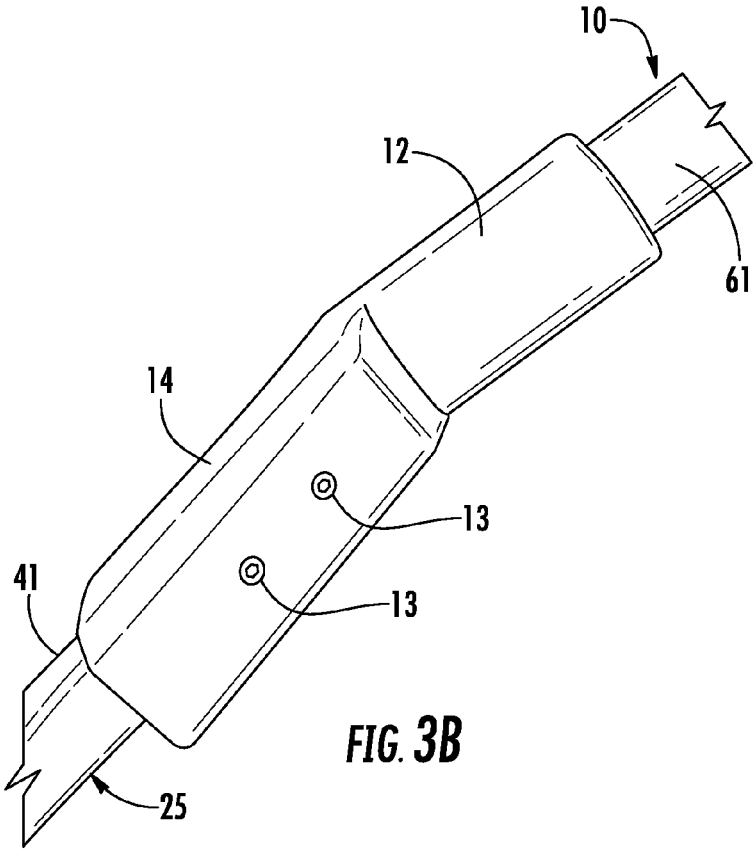
FIG. 3B is a bottom perspective view of a recreational power and stabilizing apparatus.

A second leg 14 of a coupling member 20 is coupled to a biased member 25 in one or more embodiments. FIG. 3B depicts a bottom view of a coupling member 20 illustrating a non-limiting coupling of a biased member 25 to a second leg 14 of a coupling member 20. In FIG. 3B, a portion of a biased member 25 is positioned within a receiver on the second leg 14, and removably coupled therein with one or more screws 13. It is contemplated that other embodiments may comprise any other couplings known in the art configured to couple a biased member 25 to a coupling member 20. Due to the bowed configuration of the biased member 25 shown in the non-limiting embodiment of FIGS. 1-3, the second leg 14 is angled from the first leg 12.

In other contemplated embodiments, a first end 41 of a biased member 25 is coupled to the elongated handle body 10 such that the first end 41 of the biased member 25 is offset from an end of the elongated handle body 10. In some embodiments, a coupling member is substantially triangular in shape and configured to offset the first end 41 of the biased member 25 from the end of the elongated handle body 10. More particularly, a coupling member may comprise a first leg, a second leg shorter than the first leg and approximately 90 degrees from the first leg, and a third hypotenuse leg extending from the first leg to the second leg. According to some aspects, the coupling member comprises a body receiver or coupling proximate an intersection of the first leg and the hypotenuse leg. The body receiver may comprise a hole, one or more screws, one or more pins, one or more nuts and bolts, any combination thereof, or any other receiver or coupling known in the art and configured to couple the coupling member to the elongated handle body 10. According to some aspects, the coupling member further comprises a biased member receiver proximate an intersection of the second leg and the hypotenuse leg of the coupling member. The biased member receiver may comprise a hole, one or more screws, one or more pins, one or more nuts and bolts, any combination thereof, or any other receiver or coupling known in the art and configured to couple the biased member 25 to the coupling member. In such a configuration, the first end of the biased member 25 is offset from the elongated handle body 10 of the apparatus.

It will be understood that implementations are not limited to the specific components disclosed herein, as virtually any components consistent with the intended operation of a method and/or system implementation for a recreational power and stabilizing apparatus may be utilized. Accordingly, for example, although particular biased members, handles, and the like may be disclosed, such components may comprise any shape, size, style, type, model, version, class, grade, measurement, concentration, material, weight, quantity, and/or the like consistent with the intended operation of a method and/or system implementation for a recreational power and stabilizing apparatus may be used.

In places where the description above refers to particular implementations of a recreational power and stabilizing apparatus, it should be readily apparent that a number of modifications may be made without departing from the spirit thereof and that these implementations may be applied to other recreational power and stabilizing apparatus. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A recreational power and stabilizing apparatus, comprising:

a telescoping elongated handle body configured to lock in an extended position and lock in a retracted position shorter than the extended position;

a bowed biased member coupled to the telescoping elongated handle body, the bowed biased member comprising a first end positioned proximate the telescoping elongated handle body, a second end opposite the first end, and an arc extending longitudinally relative to an axis of the telescoping elongated handle body, wherein the telescoping elongated handle body is coupled to the bowed biased member with a coupling member comprising a first leg coupled to the telescoping elongated handle body and a second leg coupled to the bowed biased member, wherein the first leg of the coupling member comprises a body receiver channel extending through the first leg;

a shoe coupled to and supported by the second end of the biased member, wherein the telescoping elongated handle body is slidable within the body receiver channel and movable between a locked operating position and a collapsed position wherein a second end of the telescoping elongated handle body is closer to the shoe than when the telescoping elongated handle body is when in the operating position; and a handle grip coupled to a first end of the elongated handle body.

2. The recreational power and stabilizing apparatus of claim 1, wherein the shoe comprises a traction element.

3. The recreational power and stabilizing apparatus of claim 1, wherein the bowed biased member comprises a leaf spring comprising one of fiberglass and carbon fiber.

4. A recreational power and stabilizing apparatus, comprising:

an elongated handle body;

a leaf spring comprising a first end coupled to the elongated handle body and a second end opposite the first end, wherein the elongated handle body is coupled to the leaf spring with a coupling member comprising a first leg coupled to the elongated handle body and a second leg coupled to the bowed biased member, and wherein the first leg of the coupling member comprises a body receiver channel extending through the first leg; and a traction element coupled to the second end of the leaf spring, wherein the elongated handle body is slidable within the body receiver channel and movable between a locked operating position and a collapsed position wherein an end of the elongated handle body is closer to the traction element than when the elongated handle body is in the operating position.

5. The recreational power and stabilizing apparatus of claim 4, wherein the leaf spring extends longitudinally relative to the elongated handle body.

6. The recreational power and stabilizing apparatus of claim 4, wherein the elongated handle body comprises a telescoping shafted body configured to lock in an extended position and lock in a retracted position shorter than the extended position.

7. The recreational power and stabilizing apparatus of claim 4, wherein the traction element is coupled to a shoe pivotally coupled to the second end of the leaf spring.

8. The recreational power and stabilizing apparatus of claim 4, wherein the leaf spring comprises one of fiberglass or carbon fiber.

9. A recreational power and stabilizing apparatus, comprising an elongated handle body coupled to a non-linear biased member, the non-linear biased member extending from a first side of the elongated handle body and not crossing a plane collinear with an axis of the elongated handle body more than once in a total length of the non-linear biased member such that the non-linear biased member deforms when a force is applied to the non-linear biased member by the elongated handle body and reforms when the force is not applied to the non-linear biased member by the elongated handle body to store and release energy during use of the recreational power and stabilizing apparatus, wherein the elongated handle body comprises a telescoping shaft configured to lock in an extended position and lock in a retracted position shorter than the extended position, and wherein the telescoping shaft is coupled to the biased member with a coupling member comprising a first leg coupled to the telescoping shaft and a second leg coupled to the biased member, wherein the first leg of the coupling member comprises a body receiver channel extending through the first leg, the telescoping shaft being slidable within the body receiver channel and movable between a locked operating position and a collapsed position.

10. The recreational power and stabilizing apparatus of claim 9, further comprising a traction element coupled to the biased member and a handle coupled to the elongated handle body.

11. The recreational power and stabilizing apparatus of claim 9, wherein the non-linear biased member comprises a leaf spring positioned longitudinally to the axis of the elongated handle body.

12. The recreational power and stabilizing apparatus of claim 11, wherein the leaf spring comprises one of fiberglass or carbon fiber.

* * * * *